United States Patent [19]

Busbach

[11] 4,072,239

[45] Feb. 7, 1978

[54] ARRANGEMENT FOR CHARGING A FURNACE IN A GASTIGHT AND DUST-TIGHT MANNER

[75] Inventor: Willi Busbach, Essen, Germany

[73] Assignees: Bergwerksverband GmbH; Didier Engineering GmbH, both of Essen, Germany

[21] Appl. No.: 765,893

[22] Filed: Feb. 7, 1977

[30] Foreign Application Priority Data

Feb. 10, 1976 Germany ..... 7603726[U]

[51] Int. Cl.[2] ..... F23K 3/00

[52] U.S. Cl. ..... 214/35 R; 214/18 PH; 202/262

[58] Field of Search ..... 214/18 PH, 35 R; 202/262, 263

[56] References Cited

U.S. PATENT DOCUMENTS

| | | | |
|---|---|---|---|
| 3,536,205 | 10/1970 | Bender | 214/18 PH X |
| 3,675,797 | 7/1972 | Pries | 214/35 R |
| 3,945,515 | 3/1976 | Busbach | 214/35 R |

*Primary Examiner*—Albert J. Makay
*Attorney, Agent, or Firm*—Michael J. Striker

[57] ABSTRACT

A furnace has a filling inlet normally closed by a removable cover. An arrangement is disclosed which opens the filling inlet, then fills the interior of the furnace, and then recloses the inlet all in gas-tight and dust-tight manner in order to prevent the free escape of dust and gases to the ambient atmosphere when the cover is removed from the filling inlet. The arrangement includes a housing surrounding the filling inlet and having a discharging port and a first opening separate from the discharging port, and a filling arrangement which is operative for conveying a charge from the discharging port through the interior of the housing and into the filling inlet when the latter is opened. A cover-extracting arrangement is operative for removing and subsequently repositioning the cover. The cover-extracting arrangement includes a hood which has a second opening and which is movable relative to the housing to and from a position in which both of said openings are juxtaposed in sealing relationship so that the interior of the hood can communicate with the interior of the housing. The cover-extracting arrangement also includes an electromagnet which is movable from the interior of the hood through the juxtaposed openings to the interior of the housing at a location adjacent the cover for engaging the latter. The electromagnet is operative for opening and subsequently reclosing the filling inlet. Thus, in accordance with the invention, any dust and gas escaping from the filling inlet towards the ambient atmosphere when the cover is removed from the filling inlet are confined within the respective interiors of the housing and the hood. Advantageously, the arrangement is used in conjunction with a battery of furnaces having respective filling inlets arranged in a row, and the cover-extracting arrangement, as a whole, is movable into sealing engagement with successive ones of the filling inlets for filling successive ones of the furnaces.

7 Claims, 1 Drawing Figure

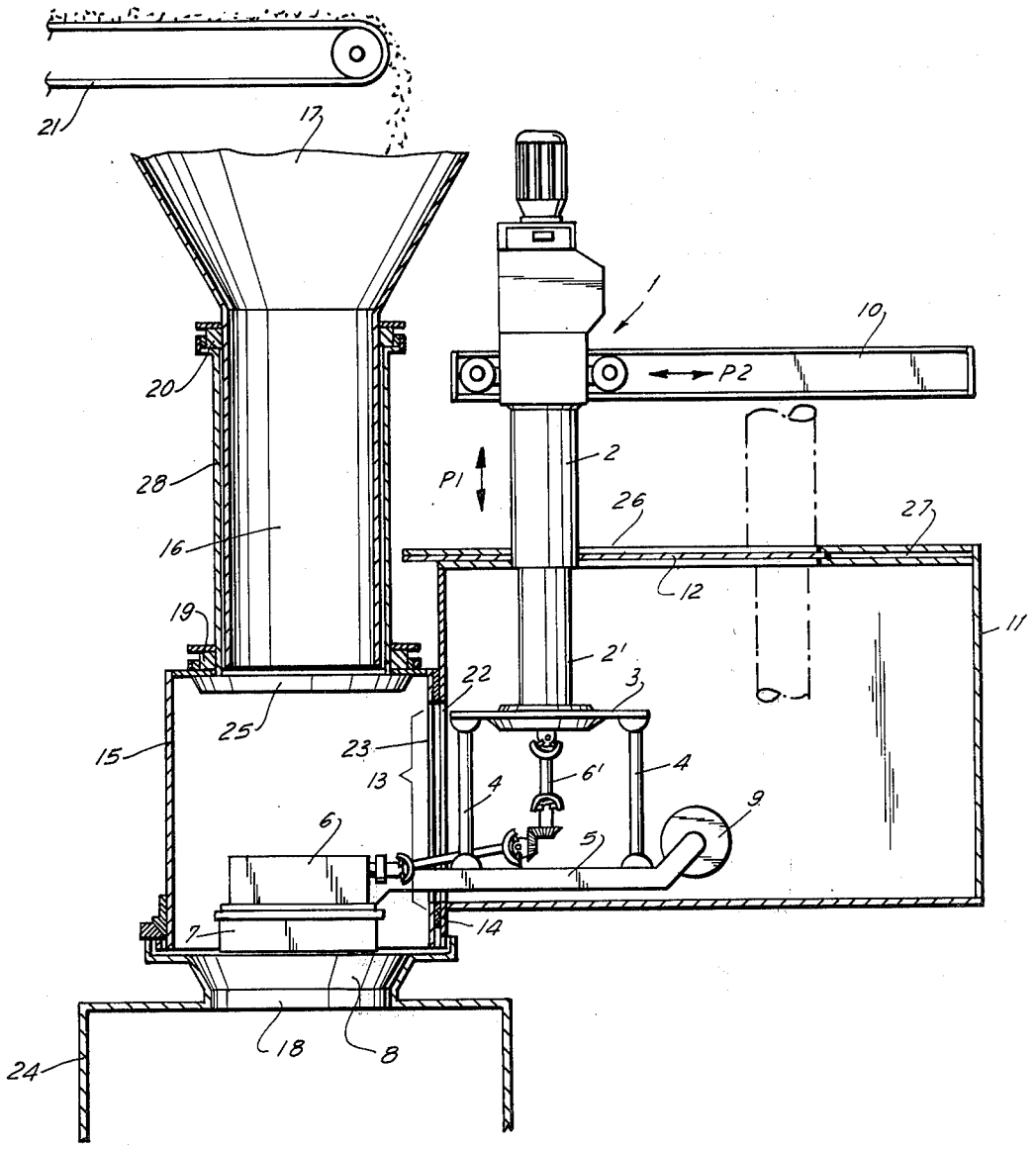
21
17
1
10
P2
20
2
P1
28
26
27
16
12
11
19
2'
22
3
25
15
23
13
6'
4
4
9
6
5
7
14
18
8
24

ARRANGEMENT FOR CHARGING A FURNACE IN A GASTIGHT AND DUST-TIGHT MANNER

BACKGROUND OF THE INVENTION

The invention relates broadly to the problem of charging a furnace without permitting gas and dust to escape freely into the ambient atmosphere.

More specifically, the invention relates to the problem of lifting off a cover of a furnace opening, charging or filling the interior of the furnace with a charge of moist or preheated coal, and then replacing the cover, without permitting gas and dust to escape freely into the ambient atmosphere.

Still more specifically, the invention relates to the problem of lifting off the covers, charging and then reclosing successive ones of the furnaces in a battery of furnaces, without permitting gas and dust to escape freely into the ambient atmosphere.

When filling the successive furnace chambers of a battery of coke furnaces with preheated coal, a great amount of gas and dust generally escapes into the atmosphere. This escape of dust and gas is environmentally detrimental and presents a serious health hazard to persons working in the vicinity of such a battery of coke furnaces. In the prior art, it has been proposed to counteract this escape of dust and gas, such as by incorporating steam jet nozzles in the furnace feed pipe or by incorporating suction ventilating devices. However, these proposed arrangements have not proven completely satisfactory inasmuch as they do not prevent the escape of a very considerable amount of dust and gas during the time interval between the completion of the filling operation and the reclosing of the furnace filling inlet.

It has also been proposed to lower a casing above a furnace and to thereupon lower a magnet through the casing onto a furnace cover so as to remove the same from the filling inlet. In addition, a filling conduit is mounted on the housing and is movable to a position above the opened filling inlet so as to charge the furnace. However, the sealing arrangement between the conduit and the casing has not proven altogether satisfactory in counteracting the escape of dust and gas towards the ambient atmosphere.

SUMMARY OF THE INVENTION

It is accordingly an object of the invention to provide an arrangement for opening the filling inlet of a furnace, filling the interior of the furnace with a charge, and then reclosing the filling inlet of the furnace, without permitting the escape of dust and gas.

Another object of the present invention is to establish a reliable gas-tight and dust-tight seal so as to prevent any dust and gas from escaping from the filling inlet towards the ambient atmosphere when a furnace cover has been removed from the filling inlet.

In keeping with these objects and others which will become apparent hereinafter, one feature of the invention is embodied in an arrangement, in combination with a furnace having a furnace filling inlet normally closed by a removable cover, for opening the filling inlet, then filling the interior of the furnace, and then reclosing the inlet all in gas-tight and dust-tight manner in order to prevent the free escape of dust and gases to the ambient atmosphere when the cover is removed from the filling inlet. The arrangement includes a housing which surrounds the filling inlet and which has a charging port and a first opening separate from the charging port. A filling arrangement is operative for conveying a charge, preferably preheated or moist coal, from the charging port through the interior of the housing and into the filling inlet when the latter is opened. The arrangement further includes cover-extracting means for removing and subsequently repositioning the cover. The cover-extracting means comprises a hood which has a second opening and which is movable relative to the housing in direction to and from a position in which both of the openings are juxtaposed in sealing relationship so that the interior of the hood communicates with the interior of the housing. The cover-extracting means also includes means mounted on the hood for engaging the cover so as to open and subsequently reclose the filling inlet. The cover-engaging means, preferably an electromagnet, is movable from the interior of the hood through the juxtaposed openings to the interior of the housing at a location adjacent the cover for engagement with the same. In accordance with the invention, any dust and gas escaping from the filling inlet towards the ambient atmosphere when the cover is removed from the filling inlet are confined within the respective interiors of the housing and the hood.

Advantageously, the arrangement cooperates with a battery of furnaces having respective filling inlets arranged in a row, the cover-extracting means being moved, as a whole, along such row, and serving to open, charge and reclose each furnace in turn, in a gas-tight and dust-tight manner.

Advantageously, the filling arrangement comprises a discharge chute having tubular portions mounted in telescoping sealing relationship with each other. The infeed end of the filling pipe arrangement receives preheated or moist coal from a conveyor arrangement, for example a hopper car, a belt-type conveyor arrangement, a drag-link conveyor, or a screw conveyor, just to mention a few possibilities.

It is a particular advantage of the invention that preheated coal be used as a charge. Preheated coal permits the subsequent heating operation in the furnace to be achieved in an economical and practical manner. However, such preheated coal is generally of a highly particulate nature and unfortunately produces a rather large amount of dust and gases during its transport. Hence, by using the sealing arrangement of the present invention, one can obtain not only an economical operation, but also an operation in which the environmental health hazard is reduced to a minimum.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE depicts in schematic manner a preferred embodiment of the invention.

DESCRIPTION OF THE PREFERRED EMBODIMENT

An upper furnace wall 24 of a furnace, which has been partially shown merely for the sake of clarity, is provided with a filling inlet 18 normally closed by a removable cover 8. A housing 15 is mounted above the inlet 18 and has a charging port 25 and a first access opening 23 separate from the discharging port 25.

A filling arrangement is mounted above the housing 15. The filling arrangement comprises a tubular member 28 mounted above the discharging port 25, and a discharge chute having a generally conically-shaped portion 17 adapted to receive a charge from a conveyor 21, and a tubular portion 16 which is slidably mounted within said tubular member 28 in telescoping relationship. In all relative adjustable positions of the discharge chute relative to the tubular member 28, seals 19 and 20 seal the interior of the filling arrangement from its exterior.

The diagrammatically-depicted conveyor 21 may be a hopper car, a belt-type conveyor, a drag-link conveyor, a screw conveyor, or any stationary or movable conveyor generally used in this art for conveying a charge, such as moist or preheated coal.

In accordance with the invention, cover-extracting means, generally designated by reference numeral 1, is operative for removing and subsequently repositioning the cover 8 relative to inlet 18. The cover-extracting means 1 includes a hood 11 which has a second access opening 22 and which is movable relative to the housing 15 to and from a position in which the access openings 22, 23 are juxtaposed at region 13 in sealing relationship. This permits the interior of hood 11 to directly communicate with the interior of housing 15, while also preventing any communication from the respective interiors with the exterior ambient atmosphere. The seal intermediate housing 15 and hood 11 is established by either direct contact of the former to the latter or preferably by placing a seal 14 of elastomeric material in a gap formed between the housing 15 and the hood 11.

The cover-extracting means 1 comprises shafts 2, 2' which are received in telescoping relationship with each other, as considered in direction of the double-headed arrow P1. A carrier plate 3 is fixedly mounted on shaft 2', and a holder arm 5 is fixedly mounted in substantially parallel relationship to plate 3 by means of spaced rods 4. One end of holder 5 is provided with a counterweight 9; the other end supports cover-engaging means 6, 7.

The cover-engaging means includes a gear drive 6, preferably a worm drive, and a magnet 7, preferably an electromagnet. The magnet 7 is operative for engaging the cover 8 with magnetic action and is rotatable by the worm gear 6 via the transmission gearing 6' to rotate the cover 8 from its seat in the inlet 18. This rotary action facilitates the subsequent lifting action by the electromagnet, as will be described in greater detail below.

The cover-extracting means 1 is also movable relative to the hood 11. Rollers provided on the means 1 are mounted for displacement along a guide rail 10 in direction of the double-headed arrow P2. In addition, an elongated slot 26 is formed in the hood 11. The means 1 extends transversely through this slot 26, and the opposite end walls of the slot 26 bound the path of displacement of the cover-extracting means 1 relative to the hood 11. These end walls actually serve to define end-limiting positions for this limited movement of the cover-extracting means.

Sealing means are provided in order to seal the interior of the hood 11 from its exterior in any displaced position of the cover-extracting means 1 relative to the hood. The sealing means comprises a slide plate 12 having an opening which tightly and sealingly embraces the shaft 2, and a slide channel 27 on the hood for receiving the plate 12 in sliding sealing relationship. The plate 12 has a length greater than the length of the elongated slot 26 so that the plate 12 always overlaps and extends beyond the wall portions bounding the slot. As can be seen in the FIGURE, a highly reliable labyrinthine-type seal is established between the interior of the hood 11 and its exterior in any displaced position of the cover-extracting means in its limited movement relative to the hood 11.

The operation of the arrangement for opening the filling inlet 18, then filling the interior of the furnace, and then reclosing the inlet 18 all in gas-tight and dust-tight manner in order to prevent the free escape of dust and gases to the ambient atmosphere when the cover 8 is removed from the filling inlet proceeds as follows:

The cover-extracting means 1, which includes parts 2, 2', 3–7, 9 and the hood 11, is movable as a unit towards a furnace filling inlet 18. It will be understood that each furnace has its own housing 15 and its own filling arrangement 16, 17, 28, and that successive furnaces form a battery of furnaces arranged in a row. Thus, the parts 2, 2', 3–7, 9 are initially entirely contained within a hood 11 and are all movable together along the row to any selected one of the furnaces.

The cover-extracting means 1 is moved towards housing 15 until it presses against the resilient seal 14. Thereupon, the cover-engaging means 6, 7 is moved from the interior of the hood 11 through the region 13 and into the interior of housing 15. The cover-engaging means 6, 7 is then lowered until the magnet 7 engages the cover 8. If necessary, the worm drive 6 rotates the magnet and cover 8 so that the latter is loosened from its seat in the inlet 18. Thereupon, the cover-engaging means 6, 7 is lifted up and then moved transversely along the guide rail 10 in direction of arrow P2 relative to the hood 11 for a distance sufficient to leave the inlet opening 18 unobstructed. An end limiting position for this range of displacement of the cover-engaging means is diagrammatically shown in the FIGURE by a dashed line representation of the shafts 2, 2'.

The filling arrangement is now operative for charging the furnace. The conveyor 21 delivers a charge to the chute 16, 17 which delivers the charge through charging opening 25 and through the housing 15 into the filling inlet 18.

After the filling of the furnace is completed, the cover-engaging means 6, 7 returns the cover 8 through the region 13 and lowers the cover 8 back onto its seat in the filling inlet 18. The electromagnet 7 is now deenergized, thus releasing the cover 8. The cover-engaging means is again lifted and retracted back through region 13. The cover-extracting means 1 is now ready to be moved to another furnace location. Only when the hood is moved to another furnace will the seal established by sealing arrangement 14 be broken.

Thus, in accordance with the invention, any dust and gas escaping from the inlet 18 when the cover 8 is removed therefrom are confined within the respective interiors of the housing 15 and the hood 11. This significantly reduces the environmental hazard during filling of a furnace. It is also advantageous to provide a suction arrangement in the interior of either the housing 15 or hood 11 to suck out any gas and dust present therein prior to separation of the hood 11 from the housing 15.

The present invention is intended to be used with a conventional battery of furnaces, each having its own respective housing 15 and filling arrangement 16, 17, 28.

However, it is also within the spirit of the invention to mount the hood 11 fixedly to the housing 15 and move both of these structures together with a discharge chute of a filling arrangement in position over a filling inlet of a furnace.

It will be understood that each of the elements described above, or two or more together, may also find a useful application in other types of constructions differing from the types described above.

While the invention has been illustrated and described as embodied in an arrangement for charging a furnace in a gas-tight and dust-tight manner, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with a furnace having a furnace filling inlet normally closed by a removable cover, an arrangement for opening the filling inlet, then filling the interior of the furnace, and then reclosing the inlet all in gas-tight and dust-tight manner in order to prevent the free escape of dust and gases to the ambient atmosphere when the cover is removed from the filling inlet, the arrangement comprising a housing surrounding the filling inlet and having a charging port and a first opening separate from said charging port; filling means for conveying a charge from said charging port through the interior of said housing and into the filling inlet when the latter is opened; and cover-extracting means for removing and subsequently repositioning the cover, including a hood having a second opening and being movable relative to said housing to and from a position in which said openings are juxtaposed in sealing relationship so that the interior of said hood communicates with the interior of said housing, said cover-extracting means also includes means mounted on said hood for engaging the cover so as to open and subsequently reclose the filling inlet, said engaging means being movable from the interior of said hood through said juxtaposed openings to the interior of said housing at a location adjacent the cover for engagement with the latter so that any dust and gas escaping from the filling inlet towards the ambient atmosphere when the cover is removed from the filling inlet are confined within the respective interiors of said housing and said hood.

2. An arrangement as defined in claim 1, wherein said cover-extracting means moves said hood to a position in which said hood defines a gap with said housing; and further comprising sealing means in said gap for establishing a gas-tight and dust-tight seal between said housing and said hood so as to prevent any dust and gas from escaping from the filling inlet towards the ambient atmosphere when the cover is removed from the filling inlet.

3. An arrangement as defined in claim 1, wherein said filling means comprises a discharge chute having tubular portions mounted in telescoping sealing relationship with each other, one of said tubular portions being in communication with said charging port; and further comprising means for transporting a charge of preheated coke to the other one of said tubular portions.

4. An arrangement as defined in claim 1; and further comprising a plurality of additional furnaces forming a battery of furnaces having respective filling inlets arranged in a row; and also comprising means for moving said cover-extracting means along said row.

5. An arrangement as defined in claim 1; and further comprising means for displacing said cover-extracting means relative to said hood, including an elongated slot formed on said hood, and a guide rail on which said cover-engaging means is mounted for displacement along the length of said slot between an end-limiting position in which said cover-engaging means is located within said hood, and another end-limiting position in which said cover-extracting means is located within said housing.

6. An arrangement as defined in claim 5; and further comprising means for sealing the interior of said hood from its exterior in any displaced position of said cover-extracting means relative to said hood, including a slide plate having an opening through which a part of said cover-extracting means extends, and a slide channel on said hood for receiving said slide plate in sliding sealing relationship, said slide plate having a length greater than the length of said elongated slot so that said plate spans said slot in all displaced positions of said cover-extracting means to thereby seal the interior of said hood from its exterior in all of said displaced positions.

7. An arrangement as defined in claim 1, wherein said cover-engaging means comprises an electromagnet.

* * * * *